US012715644B2

(12) United States Patent
Hixson

(10) Patent No.: US 12,715,644 B2
(45) Date of Patent: Aug. 25, 2026

(54) INTERMEDIATE BULK CONTAINER (IBC) AND ASSOCIATED PALLET

(71) Applicant: Elkhart Plastics LLC, Akron, OH (US)

(72) Inventor: Jacob M. Hixson, Portland, OR (US)

(73) Assignee: ELKHART PLASTICS LLC, Akron, OH (US)

( * ) Notice: Subject to any disclaimer, the term of this patent is extended or adjusted under 35 U.S.C. 154(b) by 0 days.

(21) Appl. No.: 19/073,651

(22) Filed: Mar. 7, 2025

(65) Prior Publication Data

US 2025/0206490 A1 Jun. 26, 2025

Related U.S. Application Data

(63) Continuation of application No. 18/319,534, filed on May 18, 2023, now Pat. No. 12,269,641.

(51) Int. Cl.
*B65D 1/02* (2006.01)
*B65D 19/00* (2006.01)

(52) U.S. Cl.
CPC ..... *B65D 1/0207* (2013.01); *B65D 19/0006* (2013.01); *B65D 2501/0018* (2013.01);
(Continued)

(58) Field of Classification Search
CPC ..... B65D 19/02; B65D 19/12; B65D 19/16; B65D 19/36; B65D 19/0004; B65D 1/0207; B65D 19/0006; B65D 2501/0018; B65D 2501/0081; B65D 2519/00034; B65D 2519/00069; B65D 2519/00268; B65D 2519/00796; B65D 1/18; B65D 2519/00174; B65D 2519/00208; B65D 2519/00288; B65D 2519/00318; B65D 2519/00422; B65D 2519/00497; B65D 2519/00621; B65D 2519/00716;
(Continued)

(56) References Cited

U.S. PATENT DOCUMENTS 5,657,871 A 8/1997 Waters et al.
5,794,818 A * 8/1998 Bromwell ..... B65D 11/10 220/684

(Continued)

OTHER PUBLICATIONS

CageBuster® Plastic 275 & 330 Gallon IBC Tote, https://www.snydernet.com/products/snyder-ibc-totes/plastic-ibcs/cagebuster, Snyder Industries, accessed Sep. 19, 2025, 7 pages.

(Continued)

*Primary Examiner* — Kareen K Thomas
(74) *Attorney, Agent, or Firm* — Vorys, Sater, Seymour and Pease LLP; Rex W. Miller, II

(57) ABSTRACT

An intermediate bulk container system includes a molded bottle and a pallet for supporting the molded bottle. The pallet includes a first, second, third, and fourth vertical opening each extending through upper and lower sides of the pallet. The pallet further includes first, second, third, and fourth anti-teeter bars that is each respectively arranged in the first, second, third, and fourth vertical opening. The pallet also includes a pair of spaced apart elongated slots formed in the lower surface and extending between front and rear side surfaces, and each of the anti-teeter bars intersects one of the pair of spaced apart elongated slots.

20 Claims, 6 Drawing Sheets

(52) U.S. Cl.
CPC ..... *B65D 2501/0081* (2013.01); *B65D 2519/00034* (2013.01); *B65D 2519/00069* (2013.01); *B65D 2519/00268* (2013.01); *B65D 2519/00796* (2013.01)

(58) Field of Classification Search
CPC ..... B65D 2519/00805; B65D 2519/00815; B65D 1/46; B65D 19/18; B65D 2519/00348; B65D 2519/00661; B65D 2519/00965
See application file for complete search history.

(56) References Cited

U.S. PATENT DOCUMENTS

| | | | | |
|---|---|---|---|---|
| 6,244,459 | B1 * | 6/2001 | Bouc | B65D 19/18 220/636 |
| 9,321,194 | B2 | 4/2016 | Suiter | |
| 9,440,770 | B2 | 9/2016 | Mueller | |
| 11,014,738 | B2 | 5/2021 | Spann et al. | |
| 11,027,903 | B2 | 6/2021 | Spann et al. | |
| 11,091,293 | B2 | 8/2021 | Spann et al. | |
| 11,279,554 | B2 | 3/2022 | Spann et al. | |
| 2009/0084800 | A1 | 4/2009 | Hartley et al. | |
| 2009/0294486 | A1 | 12/2009 | McKnight et al. | |
| 2014/0069942 | A1 | 3/2014 | Duquenoy et al. | |
| 2020/0369466 | A1 * | 11/2020 | Holden | B67D 7/0288 |
| 2022/0267049 | A1 * | 8/2022 | Voelker | B65D 19/38 |

OTHER PUBLICATIONS

Cagebuster™, The Sustainable Solution to Limited Life Caged IBC Totes, https://www.snydernet.com/Portals/0/PDF/IBC-PDF/cagebuster-brochure.pdf, accessed Sep. 19, 2025, 4 pages.

Payloader Plastic IBC Tote, Snyder Industries, https://www.snydernet.com/products/snyder-ibc-totes/plastic-ibcs/payloader, accessed Sep. 19, 2025, 4 pages.

* cited by examiner

INTERMEDIATE BULK CONTAINER (IBC) AND ASSOCIATED PALLET

CROSS-REFERENCE TO RELATED APPLICATIONS

This application is a continuation of U.S. patent application Ser. No. 18/319,534 filed May 18, 2023, which is incorporated herein by reference in its entirety.

BACKGROUND

An intermediate bulk container (IBC) system may facilitate the transport, storage and dispensing of bulk materials such as liquids and free-flowing powdered materials. Many IBCs are constructed with a molded bottle with a storage capacity of about 1000 liters (265 gallons) or more. The molded bottles may exhibit a generally cubic shape to permit stacking and closely packing several IBCs together, for example, on a flatbed truck. Often a pallet is provided to facilitate handling of the IBCs with a forklift, pallet jack or other heavy equipment.

To alleviate the stresses of the enclosed materials and from the weight of IBCs stacked above, some IBCs include a metallic reinforcement structure around the molded bottles. These reinforcement structures, however, add expense and may not always prevent cracking and deformation of the molded bottle. Cracking may lead to a loss of materials, which can be hazardous and further contribute to the expense. Any undue deformation of the bottles can frustrate close packing efforts and cause damage to the IBCs while handling in confined spaces. An IBC system is needed with a molded bottle that has sufficient strength to permit stacking and handling of the IBCs without compromising the internal storage volume available for bulk materials.

SUMMARY OF DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

The present disclosure generally relates to an IBC system having a molded bottle with a non-uniform wall thickness. The bottle includes vertical columns with a relatively large wall thickness and sidewalls extending between the vertical columns with a relatively small wall thickness. When the columns are loaded vertically from stacking, for example, the resultant stress may be transferred to the sidewalls. The sidewalls may have a generally ovoid shape in vertical and horizontal directions, which distributes outwardly directed forces across the ovoid shape. The ovoid shape allows for sufficient strength to be provided by the sidewalls using less material than is used to construct the vertical columns. The non-uniform wall thickness can reduce the required weight of a molded bottle without reducing a volumetric storage capacity of the molded bottle.

In accordance with one aspect of the present disclosure, a molded bottle for an intermediate bulk container system includes a bottom wall and a top wall opposite the bottom wall. A plurality of columns extend vertically from the bottom wall and define a column thickness. A plurality of sidewalls extend vertically between the bottom wall and the top wall and horizontally between the plurality of columns. The plurality of sidewalls define a sidewall thickness that is less than the column thickness.

In accordance with a further aspect of the present disclosure, an intermediate bulk container system includes a molded bottle and a pallet supporting the bottom wall of the molded bottle. The molded includes a top wall, a bottom wall, a plurality of sidewalls extending between the top wall and bottom walls and a plurality of support columns extending vertically from the bottom wall. The plurality of support columns define a column thickness that is greater than a sidewall thickness defined by the plurality of sidewalls.

BRIEF DESCRIPTION OF THE DRAWINGS

The following figures are included to illustrate certain aspects of the embodiments, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

Figure 1A:
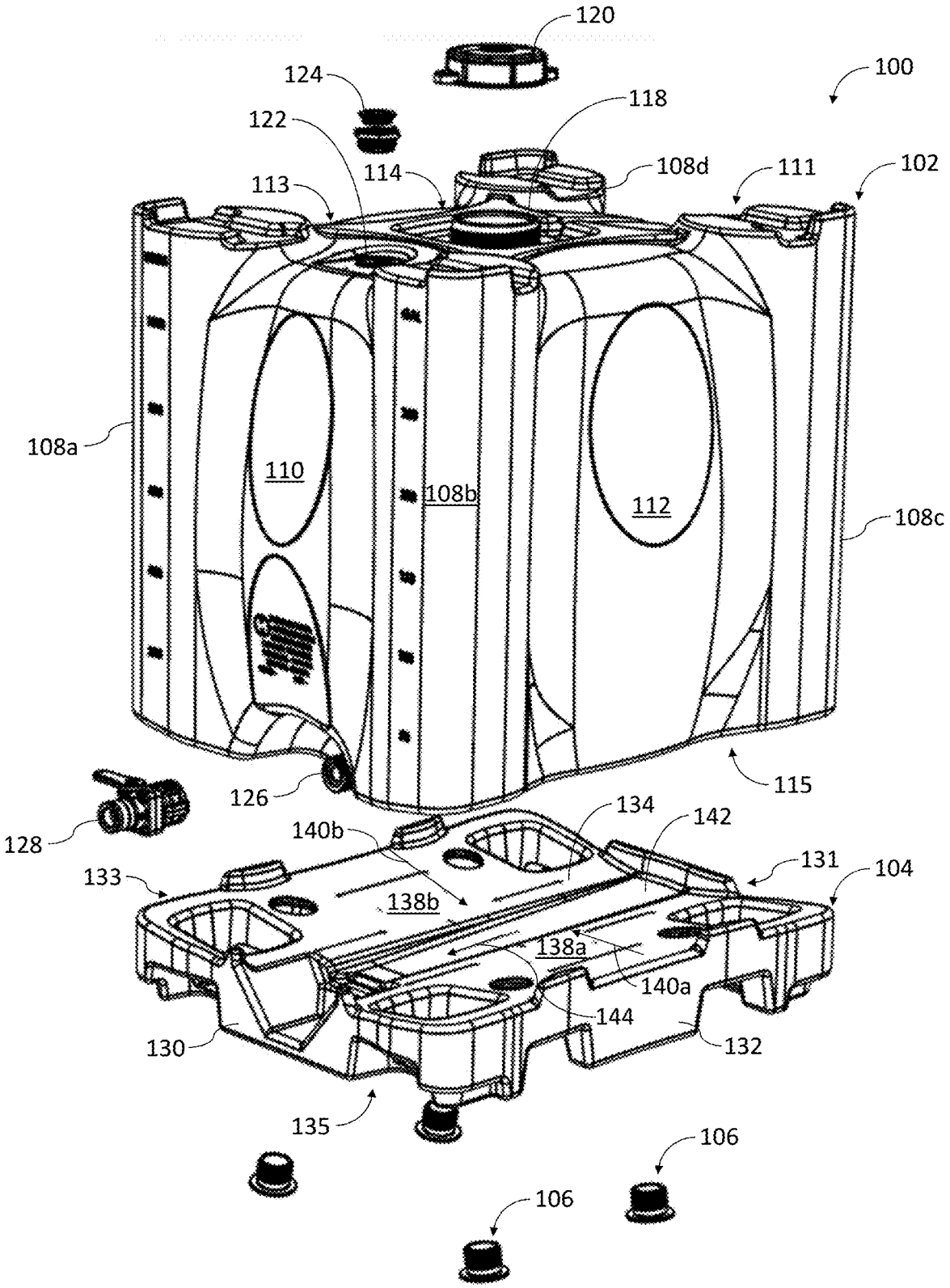
FIG. 1A is a perspective view with parts separated of an IBC system in accordance with the present disclosure illustrating a molded bottle, a pallet and various accessories of the IBC system.

A more complete understanding of the components, processes and apparatuses disclosed herein can be obtained by reference to the accompanying drawings. These figures are merely schematic representations based on convenience and the ease of demonstrating the present disclosure, and are therefore not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used herein, the terms "generally" and "substantially" are intended to encompass structural or numeral modification which do not significantly affect the purpose of the element or number modified by such term.

The terms "about" and "approximately" can be used to include any numerical value that can vary without changing the basic function of that value. When used with a range, "about" and "approximately" also disclose the range defined by the absolute values of the two endpoints, e.g. "about 2 to about 4" also discloses the range "from 2 to 4." Generally, the terms "about" and "approximately" may refer to plus or minus 10% of the indicated number.

Exemplary embodiments of the present disclosure relate to a reduced weight IBC system for a given volumetric capacity for bulk materials. To provide the reduced weight, a smaller wall thickness may be defined in areas where less material is required to support the bulk materials. A reduced weight can improve durability of the IBC systems while the IBC systems are handled and stacked for transport and storage. A pallet of the IBC system facilitates handling of the IBC system with a forklift.

Referring now to FIG. 1A, there is shown an exemplary embodiment of an IBC system 100 in accordance with the present disclosure. The IBC system generally includes a molded bottle 102, a pallet 104 and connectors 106 for securing the molded bottle 102 to the pallet 104. Each of the molded bottle 102, pallet 104 and connectors 106 may be constructed of thermoplastic polymers, such as polyethylene, with plastic molding techniques including injection molding, blow molding and rotational molding.

The molded bottle 102 may have an interior capacity of 275 gallons or more, and is generally constructed of a plurality of support columns 108*a*, 108*b*, 108*c*, 108*d* (collectively or individually, support columns 108) and a plurality of sidewalls extending between the support columns 108. Specifically, the molded bottle 102 includes front and rear sidewalls 110, 111 and right and left sidewalls 112, 113 extending between the support columns 108. Top and bottom walls 114, 115 extend between the sidewalls 110-113 and substantially enclose an interior volume of the molded bottle 102. As described in greater detail below, the support columns 108 may have a greater material thickness than the sidewalls 110-113 and/or the top and bottom walls 114, 115.

The top wall 114 includes a threaded fill opening 118 to which a fill cap 120 may be attached. The fill cap 120 may be a standard 6 or 9 inch IBC fill cap as recognized in the art. An auxiliary port 122 is defined in the top wall 114, which permits, for example, accessories to be attached to the molded bottle 102, additives to be poured into the interior of the molded bottle 102, or for collecting fluid samples from the molded bottle 102. An accessory fitting 124 may be received within the auxiliary port 122 when the auxiliary port 122 is not in use. The front sidewall 110 includes a discharge port 126 through which fluids and flowable solids (e.g., grains or powders) may be drained. A discharge valve 128 may be received within the discharge port 126 to permit an operator to selectively start and stop the flow of material through the discharge port 126.

The pallet 104 generally includes front and rear surfaces 130, 131, right and left side surfaces 132, 133 and upper and lower surfaces 134, 135. The front and rear sides may have a length of about 40 inches while the left and right side surfaces 132, 133 may have a length of about 48 inches such that the pallet 104 defines a standard 40×48 inch footprint of the IBC systems 100. In other embodiments, larger or smaller footprints may be defined.

The upper surface 134 of the pallet 104 includes inclined pads 138*a*, 138*b*, which slope downward from the right and left surfaces 132, 133 respectively in the direction of arrows 140*a*, 140*b*. A trough 142 is defined between the inclined pads 138*a*, 138*b* and slopes downward from the rear surface 131 in the direction of arrow 144. As described below, with reference to FIG. 1B, the bottom wall 115 of the molded bottle 102 includes a corresponding geometry to facilitate drainage of materials from the molded bottle 102.

Figure 1B:
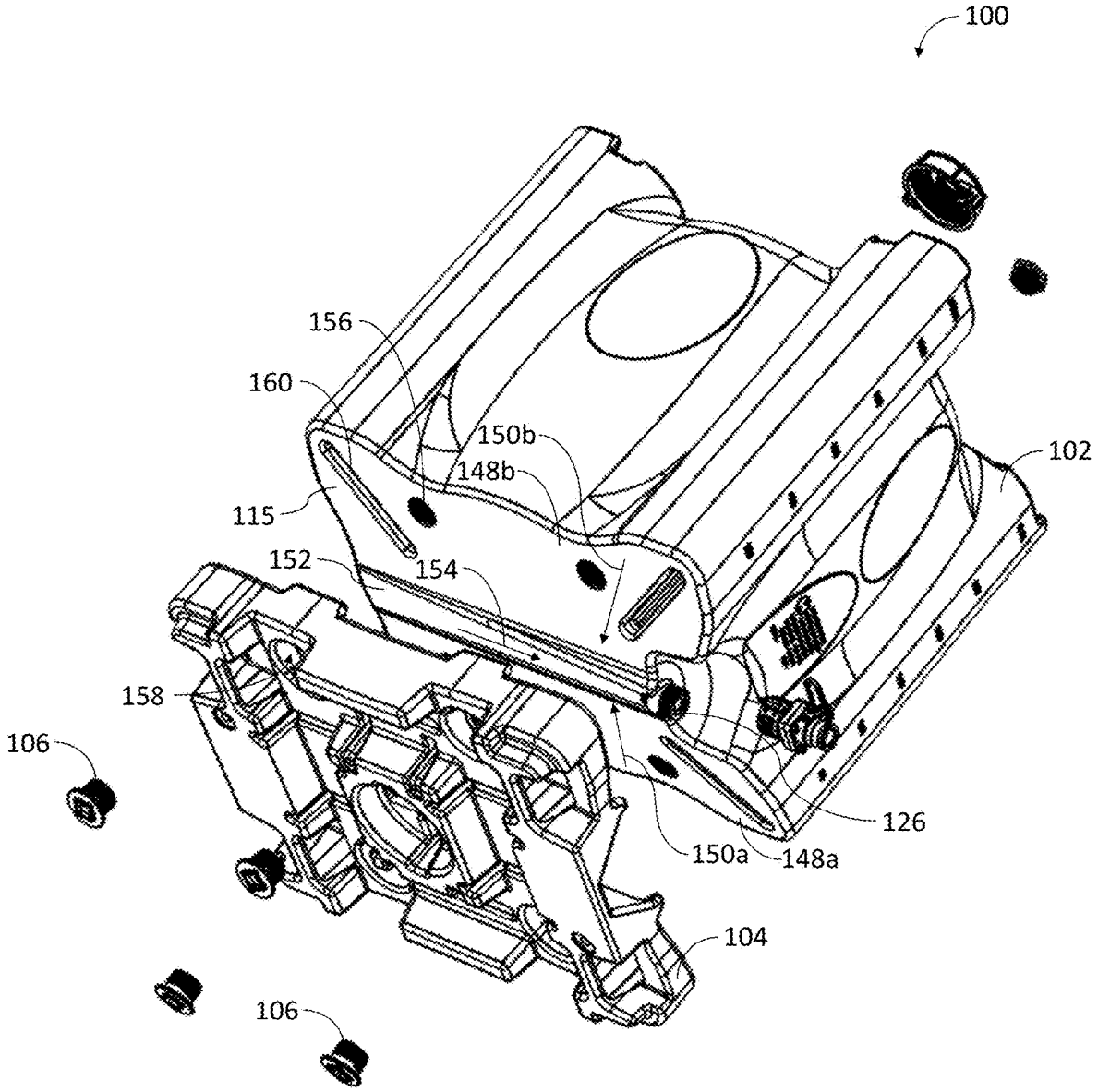
FIG. 1B is a perspective view with parts separated of the IBC system of FIG. 1 illustrating an underside of the IBC system.

Referring now to FIG. 1B, the bottom wall 115 of the molded bottle 102 includes inclined panels 148*a*, 148*b*, which slope downward from the right and left sidewalls 112, 113 respectively in the direction of arrows 150*a*, 150*b*. The inclined panels 148*a*, 148*b* are generally flat. A trough 152 is defined between the inclined panels 148*a*, 148*b* and slopes downward from the rear sidewall 111 to the discharge port 126 in the direction of arrow 154. The inclined panels 148*a*, 148*b* and the trough 152 facilitate complete drainage of molded bottle 102 through the discharge port 126. When the molded bottle 102 is placed on the pallet 104, the inclined panels 148*a*, 148*b* are fully supported on the inclined pads 138*a*, 138*b* (FIG. 1A). By providing full support of the inclined panels 148*a*, 148*b* out to the right and left sidewalls 112, 113, a greater portion of the footprint of the IBC system 100 may be occupied by the interior volume of the molded bottle 102.

A plurality of blind holes 156 are defined in the bottom wall 115 of the molded bottle 102. The blind holes 156 align with through bores 158 defined in the pallet 104 such that the connectors 106 may pass through the through bores 158 and be received in the blind holes 156. In some embodiments, the blind holes 156 and the connectors 106 may be threaded, and in some embodiments the connectors 106 may establish a friction fit with the blind holes 156 to secure the molded bottle 102 to the pallet 104. The bottom wall 115 also includes elongated indentations 160 defined therein. The elongated indentations 160 provide structural reinforcement to the inclined panels 148*a*, 148*b* of the bottom wall 115, may be constructed as kiss-offs. A kiss-off is a bridging structure formed during rotational molding at locations where two mold surfaces come in close proximity, but do not contact one another. Plastic deposited on the two mold surfaces can flow together to create the elongated indentations due to the proximity of the mold surfaces.

Figure 2A:
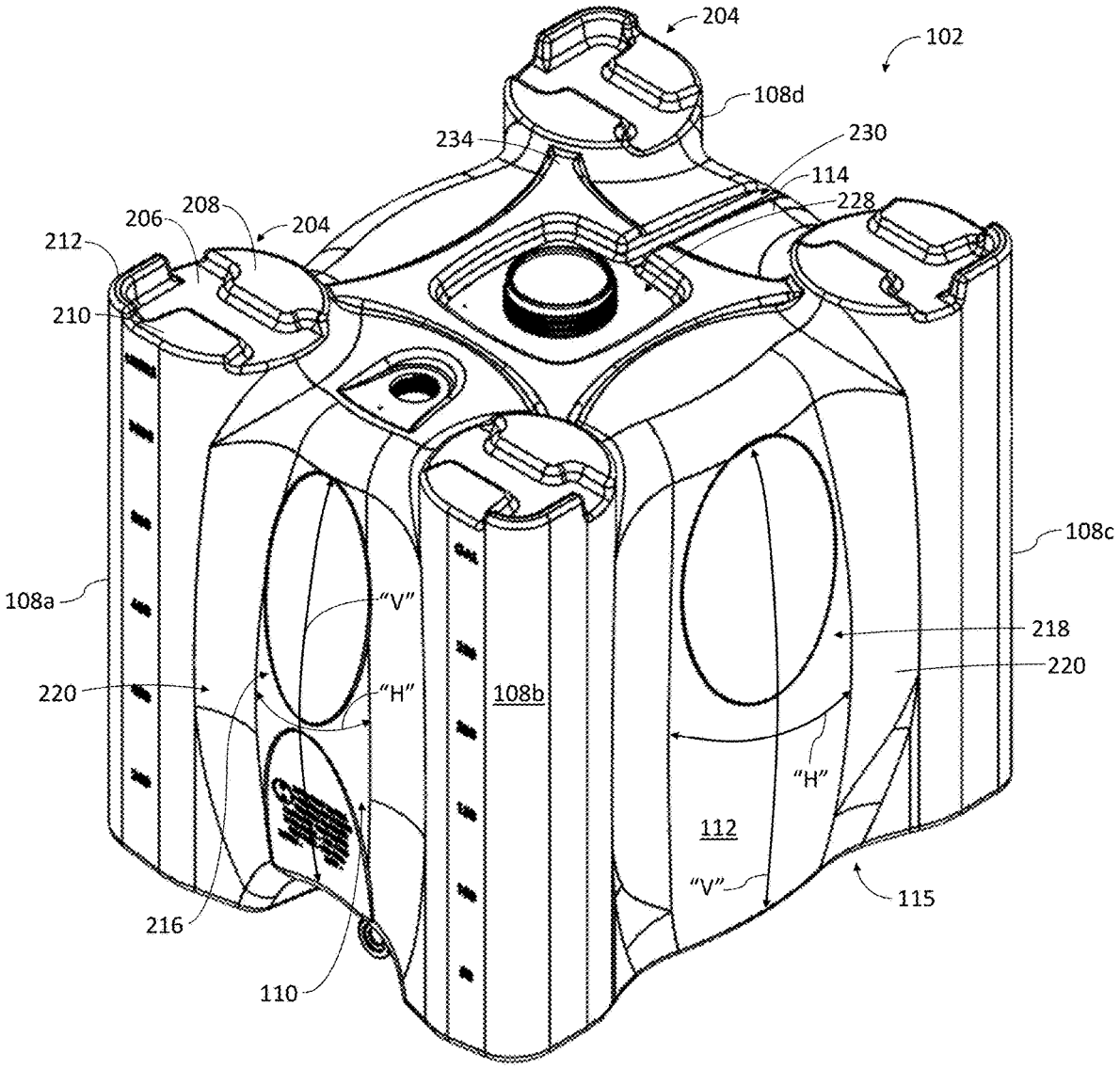
FIG. 2A is a perspective view of the molded bottle of the IBC system of FIG. 1.

Referring now to FIG. 2A, the support columns 108 of the molded bottle 102 extend vertically from the bottom wall 115 to a pallet stacking structure 204 at an upper end of each support column 108. The pallet stacking structures 204 are disposed above the top wall 114 and define the uppermost surfaces of the molded bottle 102. The pallet stacking structures 204 are arranged to securely engage a pallet 104 of an IBC system 100 to facilitate stacking IBC systems 100 on top of one another (see FIG. 4). By supporting an upper IBC system 100 on the pallet stacking structures 204, the weight of the upper IBC system 100 will be transferred through the support columns 108.

The pallet stacking structures 204 each include a flat base surface 206 with inner and outer alignment plateaus 208, 210 extending therefrom on inner and outer sides of the flat base surface 206. The alignment plateaus 208, 210 extend into similarly shaped recesses defined in lower surface 135 (FIG. 3B) of a pallet 104 when the pallet 104 is stacked thereon. A corner protrusion 212 of the pallet stacking structures 204 extends along an outermost corner of the respective column 108. The corner protrusion 212 extends to a greater height above the flat base surface 206 than the alignment plateaus 208, 210 and may serve to guide a pallet 104 into position as it is being stacked on the pallet stacking structures 204.

The front sidewall 110 extends horizontally between support columns 108*a* and 108*b*, and the right sidewall 112 extends between support columns 108*b* and 108*c*. The sidewalls 110, 112 each include a central ovoid portion 216, 218 and transitional radii 220 extending between the ovoid portions 216, 218 and the support columns 188*a*, 108*b*, 108*c*. The ovoid portions 216, 218 are curved both horizontal and vertical directions as designated by the curved arrows "H" and "V." As illustrated in FIG. 2A, the vertical curves are elongated with respect to the horizontal curves, e.g., the vertical curves span a greater vertical distance than a horizontal distance spanned by the horizontal curves. Thus, the curvature of the horizontal and vertical curves define the ovoid portions 216, 218. The sidewalls 111, 112 also include ovoid portions therein such that together, the ovoid portions sidewalls 110, 111, 112, 113 define a truncated ovoid shape (truncated by the top and bottom walls 114, 115). In other embodiments, other types of curved regions may be defined. For example, the curvature of the horizontal and vertical curves may substantially equal such that spherical portions are defined in the sidewalls 110, 113.

Single curve sections 222, 224 are provided within the ovoid portions 216, 218. The single-curve sections are curved only in one direction, e.g., the vertical direction designated by curved arrows "V." A single curve may facilitate the application of decals or other markings to identify the contents, source or other information regarding the contents of the molded bottle 102. The rear sidewall 111 and the left sidewall 113 may be constructed similarly to the front sidewall 110 and right sidewall 113, including ovoid portions 216, 218, single-curve sections 222, 224 and transitional radii 220 extending between the ovoid portions 216, 218 and the support columns 108*c*, 108*d*, 108*a*. The transitional radii 220 prevent stress concentrations from developing within the molded bottle 102.

The top wall 114 includes a concavity 228 surrounding the threaded fill opening 118. The concavity 228 provides clearance for the fill cap 120 when an IBC system 100 is stacked on the molded bottle 102 (see FIG. 4). A drain trough 230 extends between the concavity 228 and the rear sidewall 111 to prevent liquids from being captured within the concavity 228 when an IBC system 100 is stacked on the molded bottle 102. Generally surrounding the concavity 228 are a set of ribs 234 extending to the support columns 108*a*, 108*b*, 108*c*, 108*d*. The ribs 234 provide a bearing area for a pallet 104 when an IBC system 100 is stacked on the molded bottle 102. The ribs 234 transfer a portion of the weight of the IBC system 100 to the support columns 108*a*, 108*b*, 108*c*, 108*d*, which are constructed to support the weight of stacked IBC systems 100 and the pressure of internal materials within the molded bottle 102. In some embodiments, the ribs 234 and the flat base surfaces 206 of the pallet engaging structures 204 extend to a common elevation.

Figure 2C:
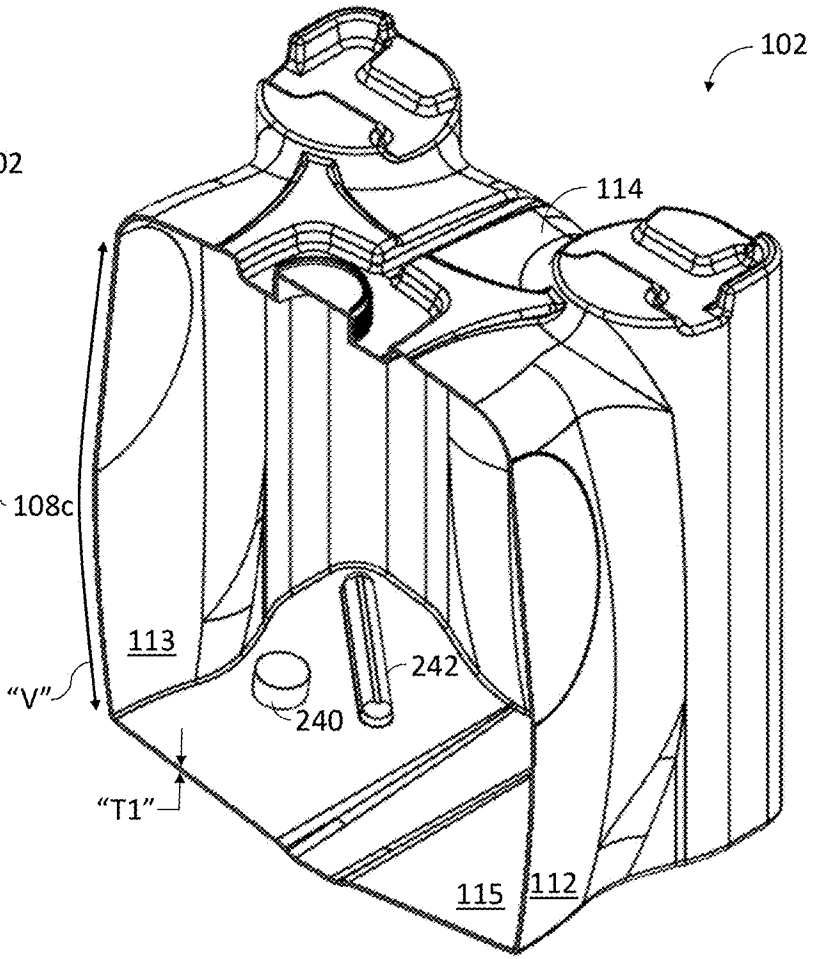
FIG. 2C is a cross-sectional perspective view of the molded bottle illustrating a vertical cross-section of the molded bottle.
Figure 2B:
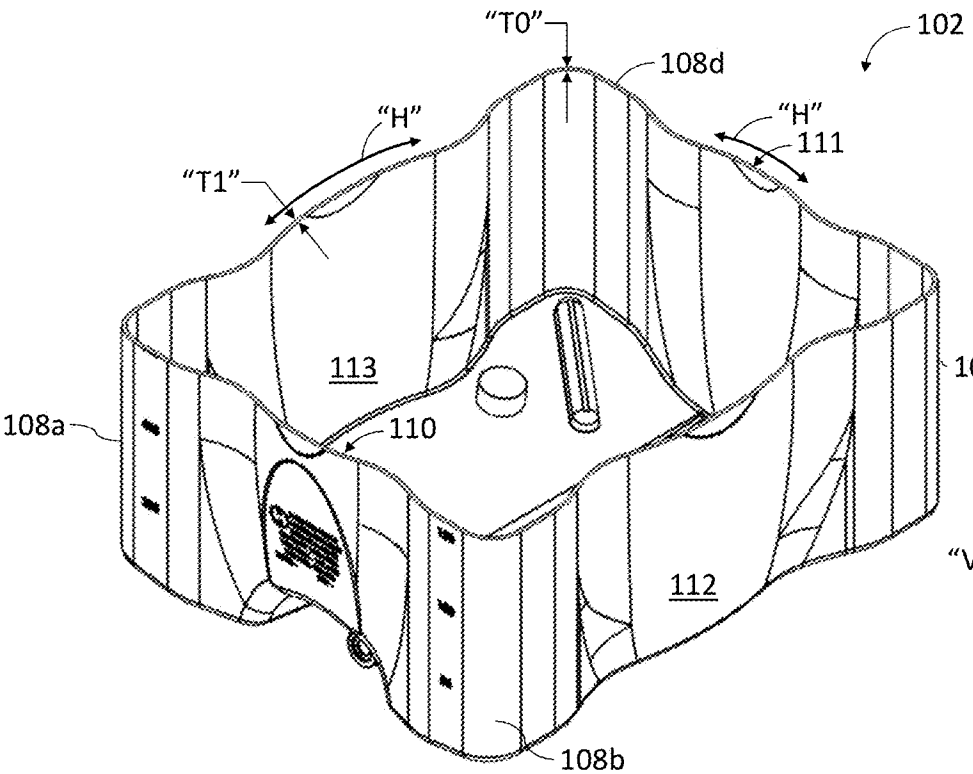
FIG. 2B is a cross-sectional perspective view of the molded bottle illustrating a horizontal cross-section of the molded bottle.

As illustrated in FIG. 2B, the support columns 108*a*, 108*b*, 108*c*, 108*d* of the molded bottle 102 are constructed to define a column thickness TO that is greater than a sidewall thickness T1. For example, the material forming the support columns 108*a*, 108*b*, 108*c*, 108*d* may have the column thickness TO while the material forming the sidewalls 110, 111, 112, 113 may have the sidewall thickness T1. In some embodiments, the column thickness TO may be at least or about 15 percent greater than the sidewall thickness T1. In other embodiments, the column thickness TO may be between about 10 and about 15 percent or between about 15 and about 40 percent greater than the sidewall thickness T1. Rotational molding processes may be defined to permit a greater amount of material to be deposited on mold surfaces forming the support columns 108*a*, 108*b*, 108*c*, 108*d* than on mold surfaces forming the sidewalls 110, 111, 112, 113.

Also illustrated in FIG. 2B, and as described above, the rear and left sidewalls 111, 113 are curved in the horizontal direction (see arrows "H") similar to the front and right sidewalls 110, 112 described above with reference to FIG. 2A.

As illustrated in FIG. 2C top and bottom walls 114, 115 of the molded bottle 102 may be constructed with the same sidewall thickness T1 as the right and left sidewalls 112, 113. A vertical curve in right and left sidewalls 112, 113 extends substantially to the bottom wall 115. An interior of the bottom wall 115 includes protrusions 240, 242, which correspond to the blind holes 156 and indentations 160 (FIG. 1B) described above.

Figure 3A:
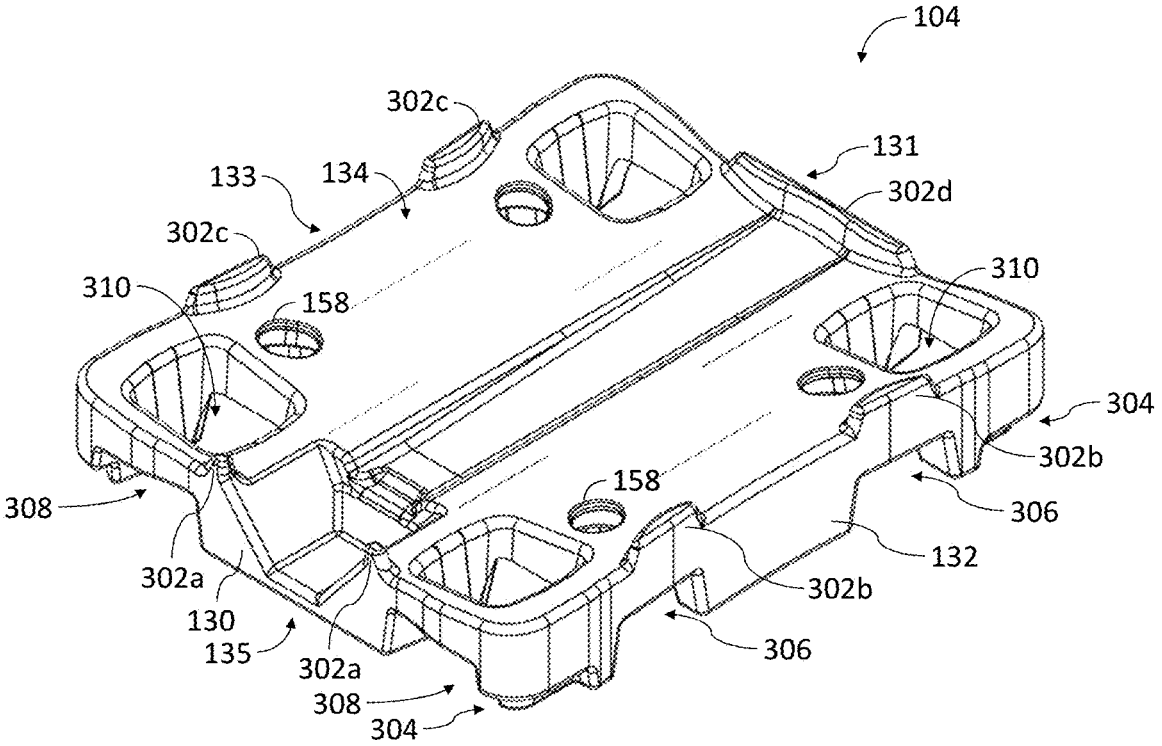
FIG. 3A is a perspective view of the pallet of the IBC system of FIG. 1.

Referring to FIG. 3A, the pallet 104 may be constructed as a one-piece molded component. The through bores 158 extend through the top surface 134 of the pallet 104 to permit passage of the connectors 106 (FIG. 1B). The through bores 158 are elongated to accommodate any deformations or misalignments that may otherwise frustrate the connection of connectors 106 to molded bottle 102. Seven stabilizing lugs 302 protrude upward at a periphery of the top surface 134, which may secure the molded bottle 104 therebetween (see, FIG. 4). Specifically two front lugs 302*a*, two right lugs 302*b*, two left lugs 302*c* and a single rear lug 302*d* extend upwardly at the front surface 130, right surface 132, left surface 133 and rear surface 131, respectively. Corner indentations 304 are defined in the front, rear right and left surfaces 130, 131, 132, 133, and are shaped to receive and interlock with the corner protrusions 212 (FIG. 2A) of the molded bottle 102 therein.

Spaced apart elongated slots 306 extend between the right and left surfaces 132, 133 of the pallet 104 and define entry slots for a forklift or other equipment for handling the IBC systems 100. Similarly, spaced apart elongated slots 308 extend between the front and rear surfaces 130, 131. Vertical openings 310 extend from the top surface 134 and intersect the elongated slots 308. The vertical openings 310 may facilitate molding of anti-teeter bars 312 (FIG. 3B) extending across the elongated slots 306. For example, a first or upper mold for the pallet 104 may extend into the vertical openings to create a top surface of the anti-teeter bars 312 as well as the top surface 134 of the pallet 104. A second or lower mold may form the lower surface 135 (FIG. 3B) of the pallet 104 including lower surfaces of the anti-teeter bars 312. In this manner, the pallet 104 may be constructed using only two molds, which can simplify demolding processes for constructing a pallet with anti-teeter bars 312 formed therein. Rotational molding techniques may facilitate construction of the pallet 104 with the vertical openings 310 defined therein.

Figure 3B:
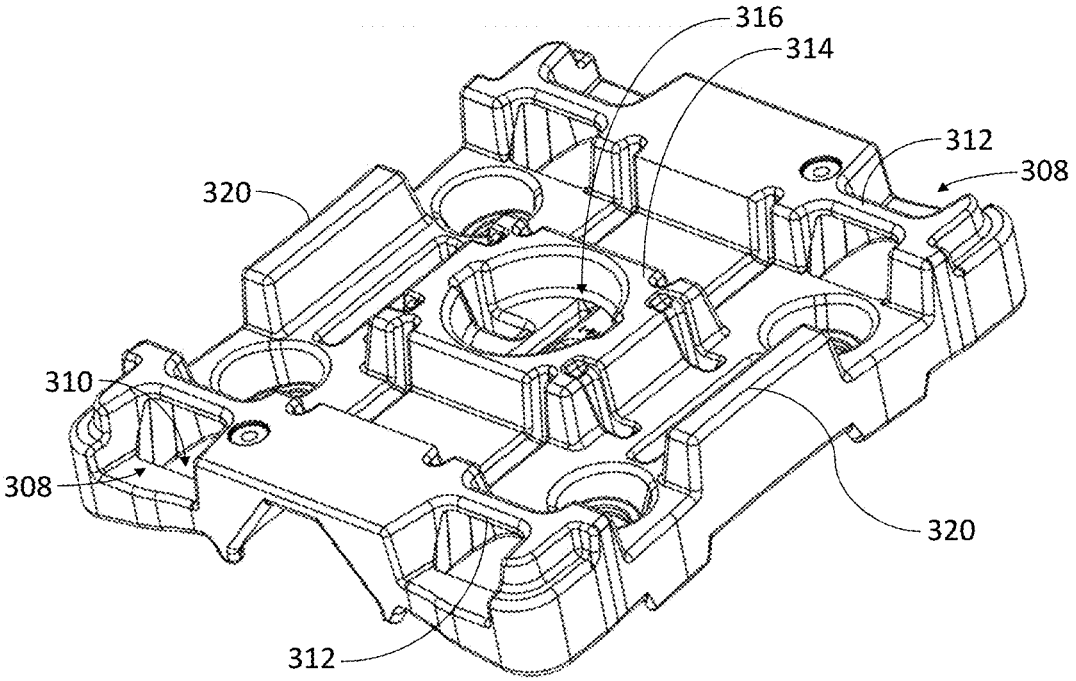
FIG. 3B is a perspective view of the pallet of the IBC system of FIG. 1 illustrating an underside of the pallet.

As illustrated in FIG. 3B, the anti-teeter bars 312 extend across the elongated slots 308. The anti-teeter bars 312 are sized and shaped to engage the flat base surface 206 and interlock with the inner and outer alignment plateaus 208, 210 of the pallet stacking structures 204 (FIG. 2A). The elongated slots 306, 308 surround a central foundation 314, which may engage the ribs 234 (FIG. 2A) on the top wall 114 of a molded bottle 102 when the pallet 104 is stacked on top of an IBC system 100. The central foundation 314 includes a generally circular clearance 316 therein to receive a fill cap 120 of the molded bottle 102 stacked below the pallet 104.

Ground supports 320 extend along the right and left surfaces 132, 133. The ground supports 320 may share a common elevation with the anti-teeter bars 312 and the central foundation 314. Together with the anti-teeter bars 312 and the central foundation 314, the ground supports 320 may support the pallet 104 when resting on a flat ground surface. The ground supports 320 do not necessarily engage the top wall 114 of a molded bottle 104 when the pallet 104 is stacked upon the molded botte 102.

Figure 4:
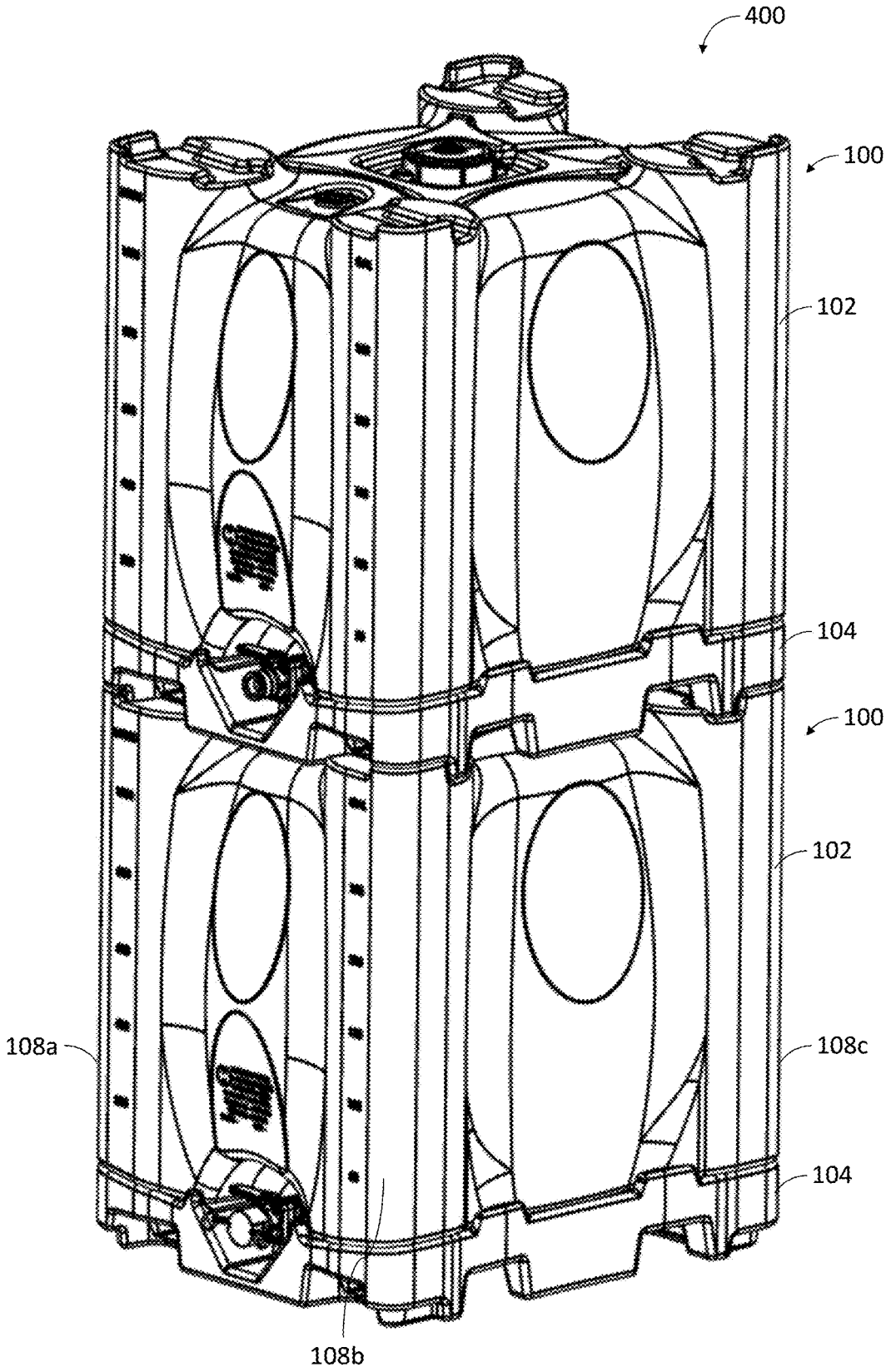
FIG. 4 is a perspective view of two IBC systems stacked vertically.

Referring now to FIG. 4, a stack 400 of two IBC systems 100 is illustrated. A stack 400 of two IBC systems may readily be loaded for transport, for example within a semi-trailer. In other embodiments (not shown), the IBC systems 100 may be stacked vertically in stacks of three or more IBC systems 100 for storage or other applications.

The pallet 104 of an upper IBC system 100 engages the pallet engaging structures 204 of a molded bottle 102 of a lower IBC system 100. The central foundation of the pallet 104 on the upper foundation bears on the ribs 234 (FIG. 2A) of the molded bottle 102 of the lower foundation. The ribs 234 transfer a portion of the weight of the upper IBC system 100 to the support columns 108*a*, 108*b*, 108*c*, 108*d* (FIG. 2B) of the molded bottle 102 of the lower IBC system 100. At least since much of the weight of an the upper IBC system 100 is carried by the support columns 108*a*, 108*b*, 108*c*, 108*d* of a molded bottle 102, the sidewalls 110, 111, 112, 113 of the molded bottle 102 may be constructed with a lower sidewall thickness T1 (FIG. 2A) than the column thickness TO of the support columns 108*a*, 108*b*, 108*c*, 108*d*. By varying the thickness of the molded bottle 102 in this manner, a total weight of the IBC system 100 may be lowered, thereby facilitating handling, stacking and storing the IBC systems 100.

To aid the Patent Office and any readers of this application and any resulting patent in interpreting the claims appended hereto, applicants do not intend any of the appended claims or claim elements to invoke 35 U.S.C. 112 (f) unless the words "means for" or "step for" are explicitly used in the particular claim.

The invention claimed is:

1. An intermediate bulk container system, comprising:

a molded bottle; and a pallet for supporting the molded bottle, wherein the pallet further comprises:

a front side surface and a rear side surface opposite the front side surface;

a pair of side surfaces extending between front and rear side surfaces, the pallet having a first corner where the front side surface meets a first of the pair of side surface, a second corner where the front side surface meets a second of the pair of side surfaces, a third corner where the rear side surface meets the second of the pair of side surfaces, and a fourth corner where the rear side surface meets the first of the pair of side surfaces;

an upper surface and a lower surface opposite the upper surface;

pair of spaced apart elongated slots formed in the lower surface and extending between the front and rear side surfaces;

a first vertical opening formed in the pallet adjacent to the first corner and extending between the upper surface and lower surface, the first vertical opening intersecting a first of the pair of spaced apart elongated slots;

a first anti-teeter bar arranged in the first vertical opening and extending across the first of the pair of spaced apart elongated slots;

a second vertical opening formed in the pallet adjacent to the second corner and extending between the upper surface and lower surface, the second vertical opening intersecting the first of the pair of spaced apart elongated slots;

a second anti-teeter bar arranged in the second vertical opening and extending across the first of the pair of spaced apart elongated slots;

a third vertical opening formed in the pallet adjacent to the third corner and extending between the upper surface and lower surface, the third vertical opening intersecting a second of the pair of spaced apart elongated slots;

a third anti-teeter bar arranged in the third vertical opening and extending across the second of the pair of spaced apart elongated slots;

a fourth vertical opening formed in the pallet adjacent to the fourth corner and extending between the upper surface and lower surface, the fourth vertical opening intersecting the second of the pair of spaced apart elongated slots; and a fourth anti-teeter bar arranged in the fourth vertical opening and extending across the second of the pair of spaced apart elongated slots.

2. The intermediate bulk container system of claim 1, wherein the pallet is constructed a one-piece molded component formed via rotational molding.

3. The intermediate bulk container system of claim 1, wherein the upper surface includes a pair of inclined pads and a trough defined between the pair of inclined pads, with a first of the inclined pads sloping downward from a first of the pair of side surfaces towards the trough and a second of the inclined pads sloping downward from a second of the pair of side surfaces towards the trough, and with the trough sloping downward from the rear side surface towards the front surface.

4. The intermediate bulk container system of claim 1, wherein the pallet includes a plurality of through bores extending through the pallet, between the upper and lower surfaces, for receiving connectors that couple the molded bottle to the pallet.

5. The intermediate bulk container system of claim 1, further comprising a plurality of stabilizing lugs protruding upward from a periphery of the upper surface.

6. The pallet of claim 5, wherein the plurality of stabilizing lugs includes a pair of lugs positioned at the periphery of the upper surface at the front surface, a pair of lugs positioned at the periphery of the upper surface at a first of the pair of side surfaces, a pair of lugs positioned at the periphery of the upper surface at a second of the pair of side surfaces, and a single lug positioned at the periphery of the upper surface at rear side surface.

7. The intermediate bulk container system of claim 1, further comprising a plurality corner indentations defined in the front side surface, the rear side surface, and the pair of side surfaces, with a first of the corner indentations defined in the first corner, a second of the corner indentations defined in the second corner, a third of the corner indentations defined in the third corner, and a fourth of the corner indentations defined in the fourth corner.

8. The intermediate bulk container system of claim 1, wherein the pair of spaced apart elongated slots is a first pair of spaced apart elongated slots, and the pallet further comprises: a second pair of spaced apart elongated slots formed in the lower surface and extending between the pair of side surfaces, the second pair of spaced apart elongated slots configured to receive forks of a forklift and intersect the first pair of spaced apart elongated slots.

9. The pallet of claim 8, wherein the pallet further includes a central foundation arranged on the lower side of the pallet, wherein the first and second pairs of spaced apart elongated slots surround the central foundation.

10. The intermediate bulk container system of claim 9, wherein a circular clearance is defined in the central foundation.

11. The intermediate bulk container system of claim 9, further comprising a first ground support extending from the lower surface at the first of the pair of side surfaces and a second ground support extending from the lower surface at the second of the pair of side surfaces, wherein:

the first and second ground supports protrude from the lower surface such that they each share a common elevation with each of the first, second, third, and fourth anti-teeter bars, as well as with the central foundation, and such that, when the pallet is resting on a flat ground surface the first and second ground supports, the first, second, third, and fourth anti-teeter bars, and the central support will all contact the flat ground surface and thereby support the pallet.

12. The intermediate bulk container system of claim 1, further comprising a first ground support extending from the lower surface at the first of the pair of side surfaces and a second ground support extending from the lower surface at the second of the pair of side surfaces, wherein the first and second ground supports protrude from the lower surface such that they each share a common elevation with each of the first, second, third, and fourth anti-teeter bars, and such that the first and second ground support and the first, second, third, and fourth anti-teeter bars will support the pallet when resting on a flat ground surface.

13. The intermediate bulk container system of claim 1, wherein the lower surface onto each of the first, second, third, and fourth anti-teeter bars.

14. A pallet for supporting a molded bottle, the pallet comprising:

a front side surface and a rear side surface opposite the front side surface;

a pair of side surfaces extending between front and rear side surfaces, the pallet having a first corner where the front side surface meets a first of the pair of side surface, a second corner where the front side surface meets a second of the pair of side surfaces, a third corner where the rear side surface meets the second of the pair of side surfaces, and a fourth corner where the rear side surface meets the first of the pair of side surfaces;

an upper surface and a lower surface opposite the upper surface;

pair of spaced apart elongated slots formed in the lower surface and extending between the front and rear side surfaces;

a first vertical opening formed in the pallet adjacent to the first corner and extending between the upper surface and lower surface, the first vertical opening intersecting a first of the pair of spaced apart elongated slots;

a first anti-teeter bar arranged in the first vertical opening and extending across the first of the pair of spaced apart elongated slots;

a second vertical opening formed in the pallet adjacent to the second corner and extending between the upper surface and lower surface, the second vertical opening intersecting the first of the pair of spaced apart elongated slots;

a second anti-teeter bar arranged in the second vertical opening and extending across the first of the pair of spaced apart elongated slots;

a third vertical opening formed in the pallet adjacent to the third corner and extending between the upper surface and lower surface, the third vertical opening intersecting a second of the pair of spaced apart elongated slots;

a third anti-teeter bar arranged in the third vertical opening and extending across the second of the pair of spaced apart elongated slots;

a fourth vertical opening formed in the pallet adjacent to the fourth corner and extending between the upper surface and lower surface, the fourth vertical opening intersecting the second of the pair of spaced apart elongated slots; and a fourth anti-teeter bar arranged in the fourth vertical opening and extending across the second of the pair of spaced apart elongated slots.

15. A method of manufacturing a pallet for supporting a molded bottle, the method comprising:

molding a pallet comprising:

a front side surface and a rear side surface opposite the front side surface;

a pair of side surfaces extending between front and rear side surfaces, the pallet having a first corner where the front side surface meets a first of the pair of side surface, a second corner where the front side surface meets a second of the pair of side surfaces, a third corner where the rear side surface meets the second of the pair of side surfaces, and a fourth corner where the rear side surface meets the first of the pair of side surfaces;

an upper surface and a lower surface opposite the upper surface;

pair of spaced apart elongated slots formed in the lower surface and extending between the front and rear side surfaces;

a first vertical opening formed in the pallet adjacent to the first corner and extending between the upper surface and lower surface, the first vertical opening intersecting a first of the pair of spaced apart elongated slots;

a first anti-teeter bar arranged in the first vertical opening and extending across the first of the pair of spaced apart elongated slots;

a second vertical opening formed in the pallet adjacent to the second corner and extending between the upper surface and lower surface, the second vertical opening intersecting the first of the pair of spaced apart elongated slots;

a second anti-teeter bar arranged in the second vertical opening and extending across the first of the pair of spaced apart elongated slots;

a third vertical opening formed in the pallet adjacent to the third corner and extending between the upper surface and lower surface, the third vertical opening intersecting a second of the pair of spaced apart elongated slots;

a third anti-teeter bar arranged in the third vertical opening and extending across the second of the pair of spaced apart elongated slots;

a fourth vertical opening formed in the pallet adjacent to the fourth corner and extending between the upper surface and lower surface, the fourth vertical opening intersecting the second of the pair of spaced apart elongated slots; and a fourth anti-teeter bar arranged in the fourth vertical opening and extending across the second of the pair of spaced apart elongated slots.

16. The method of claim 15, wherein the molding the pallet further comprises:

forming a top surface of each of the first, second, third, and fourth anti-teeter bars with an upper mold that extends into the first, second, third, and fourth vertical openings; and forming the lower surface of the pallet with a lower mold.

17. The method of claim 16, wherein the forming the lower surface of the pallet further comprises:

forming a lower surface of the first, second, third, and fourth anti-teeter bars with the lower mold.

18. The method of claim 15, wherein the molding the pallet further comprises:

rotationally molding the pallet.

19. The method of claim 15, wherein the molding the pallet further comprises:

injection molding the pallet.

20. The method of claim 15, wherein the molding the pallet further comprises:

blow molding the pallet.

* * * * *